US011274566B2

(12) United States Patent
Ciamarra et al.

(10) Patent No.: US 11,274,566 B2
(45) Date of Patent: Mar. 15, 2022

(54) AXIAL RETENTION GEOMETRY FOR A TURBINE ENGINE BLADE OUTER AIR SEAL

(71) Applicant: United Technologies Corporation, Farmington, CT (US)

(72) Inventors: Christina G. Ciamarra, Kittery, ME (US); Anthony B. Swift, Waterboro, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 108 days.

(21) Appl. No.: 16/552,347

(22) Filed: Aug. 27, 2019

(65) Prior Publication Data

US 2021/0062670 A1 Mar. 4, 2021

(51) Int. Cl.

| | |
|---|---|
| ***F01D 11/08*** | (2006.01) |
| ***F01D 25/24*** | (2006.01) |
| ***F01D 11/00*** | (2006.01) |

(52) U.S. Cl.

CPC ..... *F01D 11/08* (2013.01); *F01D 11/005* (2013.01); *F01D 25/246* (2013.01); *F05D 2220/32* (2013.01); *F05D 2240/11* (2013.01)

(58) Field of Classification Search

CPC ..... F01D 11/08; F01D 11/005; F01D 25/246; F05D 2240/11

See application file for complete search history.

(56) References Cited

U.S. PATENT DOCUMENTS

| | | | | |
|---|---|---|---|---|
| 3,365,173 | A * | 1/1968 | Lynch | F01D 9/042 415/209.3 |
| 2009/0067994 | A1* | 3/2009 | Pietraszkiewicz | F01D 11/08 415/173.1 |
| 2009/0087306 | A1* | 4/2009 | Tholen | B22C 9/10 415/173.1 |
| 2011/0044801 | A1* | 2/2011 | Di Paola | F01D 9/04 415/173.1 |
| 2016/0362992 | A1* | 12/2016 | Roy Thill | F01D 11/003 |
| 2017/0268371 | A1* | 9/2017 | McCaffrey | F02C 7/28 |
| 2018/0051590 | A1 | 2/2018 | Tableau et al. | |
| 2018/0080343 | A1* | 3/2018 | Groleau | F01D 25/005 |
| 2019/0211701 | A1 | 7/2019 | Ciamarra et al. | |

FOREIGN PATENT DOCUMENTS

| | | |
|---|---|---|
| EP | 3498978 | 6/2019 |
| EP | 3517738 | 7/2019 |
| WO | 2016146942 | 9/2016 |

OTHER PUBLICATIONS

European Search Report for Application No. 20192935.3 dated Nov. 10, 2020.

* cited by examiner

*Primary Examiner* — Woody A Lee, Jr.

*Assistant Examiner* — Wesley Le Fisher

(74) *Attorney, Agent, or Firm* — Carlson, Gaskey & Olds, P.C.

(57) ABSTRACT

A blade outer air seal for a gas turbine engine includes a platform having a leading edge and a trailing edge. A pair of circumferential edges connect the leading edge and the trailing edge. An end wall protrudes radially outward from the platform at the trailing edge. A first support rib connects one of the circumferential edges to the end wall and structurally supports the end wall. A first boss portion extends axially forward from the end wall and is disposed radially outward of the first support rib.

7 Claims, 2 Drawing Sheets

AXIAL RETENTION GEOMETRY FOR A TURBINE ENGINE BLADE OUTER AIR SEAL

TECHNICAL FIELD

The present disclosure relates generally to blade outer air seal constructions for a gas turbine engine, and more specifically to a blade outer air seal construction including a geometry feature for axial retention during assembly.

BACKGROUND

Gas turbine engines, such as those utilized in commercial and military aircraft, include a compressor section that compresses air, a combustor section in which the compressed air is mixed with a fuel and ignited, and a turbine section across which the resultant combustion products are expanded. The expansion of the combustion products drives the turbine section to rotate. As the turbine section is connected to the compressor section via a shaft, the rotation of the turbine section further drives the compressor section to rotate. In some examples, a fan is also connected to the shaft and is driven to rotate via rotation of the turbine as well.

The primary flowpath connecting the compressor, the combustor, and the turbine section is defined by multiple flowpath components including vanes, rotors, blade outer air seals and the like. In order to ensure ideal airflow through the primary flowpath, blade outer air seals are disposed radially outward of the rotors. The blade outer air seals are arranged in a circumferential manner.

SUMMARY OF THE INVENTION

In one exemplary embodiment a blade outer air seal for a gas turbine engine includes a platform having a leading edge and a trailing edge, a pair of circumferential edges connecting the leading edge and the trailing edge, an end wall protruding radially outward from the platform at the trailing edge, a first support rib connecting one of the circumferential edges to the end wall and structurally supporting the end wall, and a first boss portion extending axially forward from the end wall, the first boss portion being disposed radially outward of the first support rib.

In another example of the above described blade outer air seal for a gas turbine engine the first boss portion is tapered such that a radially outer end of the boss portion is circumferentially thinner than a radially inner end of the boss portion.

In another example of any of the above described blade outer air seals for a gas turbine engine the first boss portions has a constant circumferential width.

In another example of any of the above described blade outer air seals for a gas turbine engine the first boss portions extends the full radial length of the end wall.

In another example of any of the above described blade outer air seals for a gas turbine engine the first boss portion extends a partial radial length of the end wall.

In another example of any of the above described blade outer air seals for a gas turbine engine each circumferential edge in the pair of circumferential edges lacks a radial step.

In another example of any of the above described blade outer air seals each circumferential edge in the pair of circumferential edges includes a circumferentially intruding feather seal slot.

Another example of any of the above described blade outer air seals for a gas turbine engine further includes a second support rib connecting another of the circumferential edges to the end wall, and comprising a second boss portion extending axially forward from the end wall, the second boss portion being disposed radially outward of the second support rib.

In another example of any of the above described blade outer air seals for a gas turbine engine the first boss portion is continuous with the first support rib.

In another example of any of the above described blade outer air seals for a gas turbine engine the first boss portion is discontinuous with the first support rib.

In one exemplary embodiment a gas turbine engine includes a fluid flowpath connecting a multi-stage compressor section, a combustor section, and a multi-stage turbine section, at least one stage of the multi-stage compressor section and the multi-stage turbine section comprising a ring of blade outer air seals connected to an engine case via a static support structure, wherein each blade outer air seal in the ring of blade outer air seals comprises, a platform having a leading edge and a trailing edge, a pair of circumferential edges connecting the leading edge and the trailing edge, an end wall protruding radially outward from the platform at the trailing edge, a first support rib connecting one of the circumferential edges to the end wall and structurally supporting the end wall, and a first boss portion extending axially forward from the end wall, the first boss portion being disposed radially outward of the first support rib.

Another example of the above referenced gas turbine engine further includes a gap between a forward facing radially aligned surface of each first boss portion and an aftward facing radially aligned surface of the static support structure.

In another example of any of the above described gas turbine engines the gap has an axial length in the range of 0.010-0.050 inches (0.254-1.27 mm).

In another example of any of the above described gas turbine engines each boss portion at least partially radially overlaps the aftward facing radially aligned surface.

In another example of any of the above described gas turbine engines the first boss portion is tapered such that a radially outer end of the boss portion is circumferentially thinner than a radially inner end of the boss portion.

In another example of any of the above described gas turbine engines the first boss portions has a constant circumferential width.

In another example of any of the above described gas turbine engines the first boss portions extends the full radial length of the end wall.

In another example of any of the above described gas turbine engines the first boss portion extends a partial radial length of the end wall.

In another example of any of the above described gas turbine engines each circumferential edge in the pair of circumferential edges lacks a radial step.

In another example of any of the above described gas turbine engines each circumferential edge in the pair of circumferential edges includes a circumferentially intruding feather seal slot.

These and other features of the present invention can be best understood from the following specification and drawings, the following of which is a brief description.

DETAILED DESCRIPTION

Figure 1:
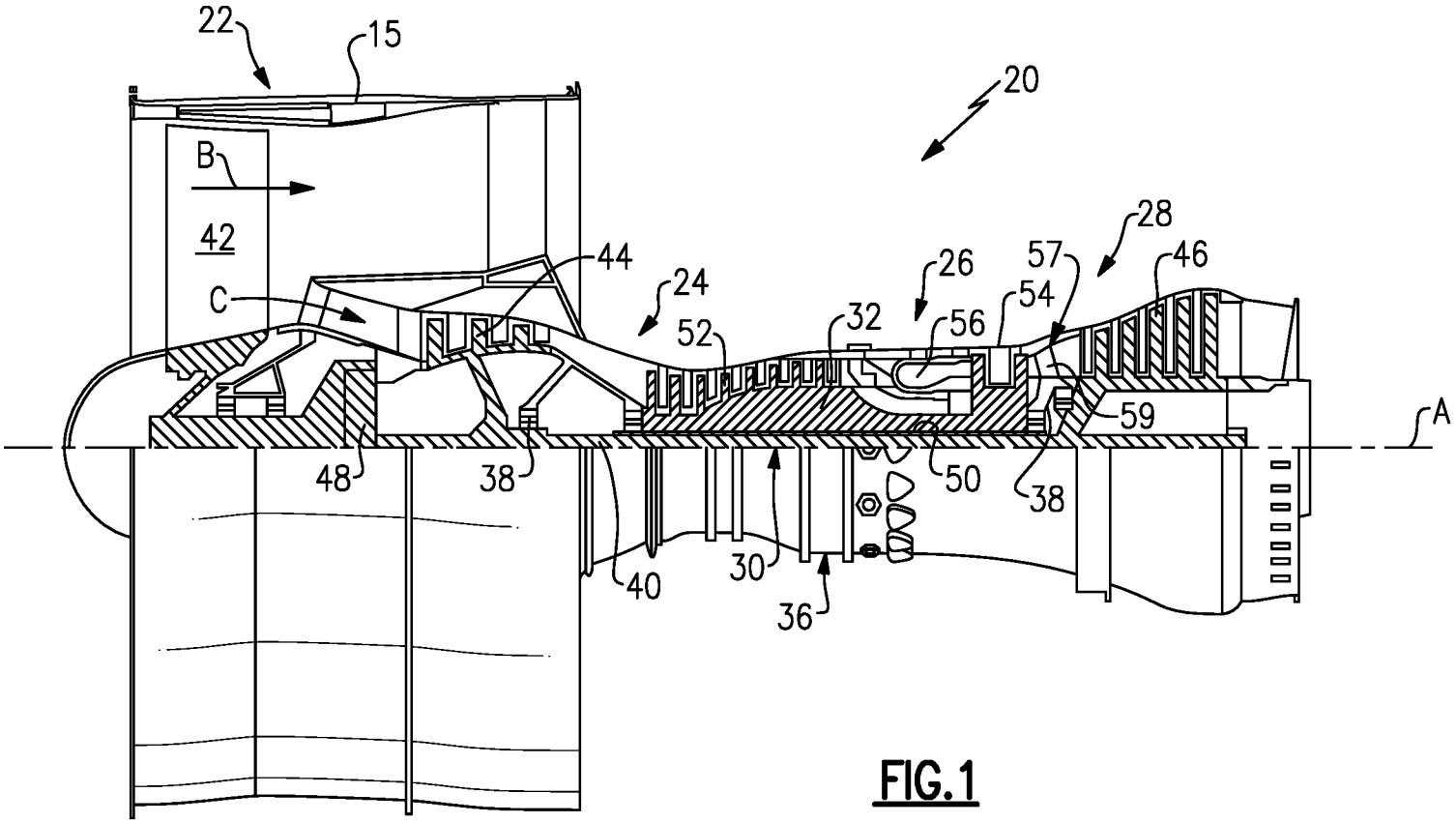
FIG. 1 illustrates a high level schematic view of an exemplary imaging system.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 meters/second).

Included within the compressor and turbine sections are multiple stages, each of which includes rotors and vanes. At an axial position of each of the rotors the radially outward portion of the primary flowpath C is comprised of a circumferential arrangement of blade outer air seals. Each of the blade outer air seals includes a circumferential feather seal slot configured to receive a feather seal and seal a gap that can exist between the blade outer air seal and a circumferentially adjacent blade outer air seal. During assembly, the blade outer air seals are subject to axial shifting, relative to an axis of the engine. The axial shifting can result in difficulty in assembly and misalignment resulting in increased assembly times and costs.

In order to prevent axial misalignment, existing blade outer air seals incorporate a radial step that protrudes radially outward from a circumferential side of the blade outer air seal, with the step being at an approximate center of the circumferential side. The radial step interfaces with a radially inward protruding support tab of a support connection the blade outer air seal to the engine case. The support tab prevents further axial shifting of the blade outer air seal, and eases construction of the component by preventing the blade outer air seal from falling axially forward during assembly.

Figure 2:
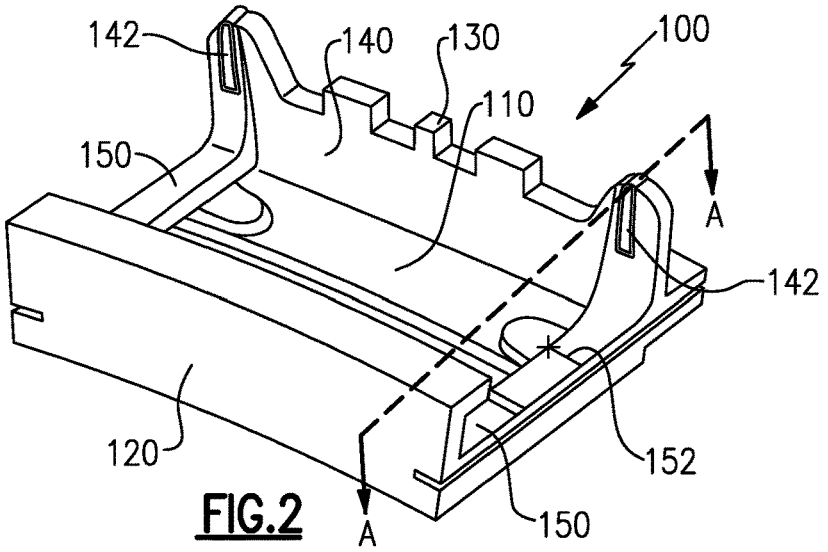
FIG. 2 schematically illustrates an isometric view of a blade outer air seal assembly.

With continued reference to FIG. 1, FIG. 2 schematically illustrates an isometric view of a blade outer air seal 100 including a platform 110. The blade outer air seal 100 includes an upstream edge 120 and a downstream edge 130, with upstream and downstream being defined by an expected direction of flow through the gas turbine engine during conventional engine operations. The upstream edge 120 and the downstream edge 130 are connected by circumferential edges 150. As used throughout this disclosure radially, axially, circumferentially, and similar relative terms are defined with reference to a centerline axis of the gas turbine engine in which the components are to be installed.

Each circumferential edge 150 of the platform 110 extends radially outward from the platform 110. Intruding into each circumferential edge 150 is a feather seal slot for receiving a feather seal and sealing against an adjacent blade outer air seal 100. In order to improve the feather seal connection between each blade outer air seal 100 and the adjacent blade outer air seals 100, a circumferential edge of the blade outer air seal 100 extends radially outward relative to previous designs. The extension prevents the feathers seal slot from radially breaking out (extending through a surface) of the blade outer air seal 100 along the entire axial length of the blade outer air seal, thereby improving performance of the blade outer air seal. The extension of the circumferential edge occurs at the previous location of the radial step that is used to prevent axial shifting in previous designs. As a result of the extension, the radial step is omitted and, absent other features, the blade outer air seal 100 is susceptible to axial shifting during assembly.

In order to mitigate the possibility of axial shifting, the downstream portion of the platform 110 includes a radially protruding wall 140. The radially protruding end wall 140 is at least partially supported on the platform 110 via support ribs 146 that connect the circumferential edge 150 to the support wall 140.

Extending radially outward from a radially outward end of each of the ribs 146 is a boss portion 142. The boss portion 142 also extends axially forward from the protruding wall 140, and has a circumferential width less than a circumferential width 152 of the circumferential edge 150. In the illustrated example, the boss portion 142 is tapered, with a circumferentially thinner end at a radially outermost position and a circumferentially wider end at a position where the rib 146 transitions into the boss portion 142. In alternative examples, the boss portion 142 can have an even circumferential width and function in a similar manner. In the illustrated example, a boss portion 142 is disposed at each circumferential end of the wall 140. In alternative examples, the boss portion 142 can be omitted from one of the circumferential ends of the wall 140.

Figure 3:
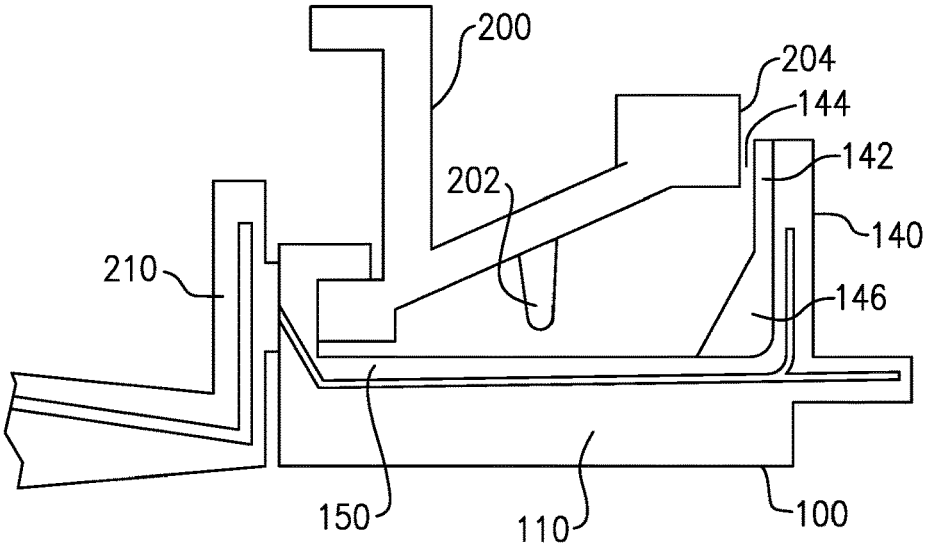
FIG. 3 schematically illustrates a cross sectional view of the blade outer air seal assembly of FIG. 2.
Figure 4:
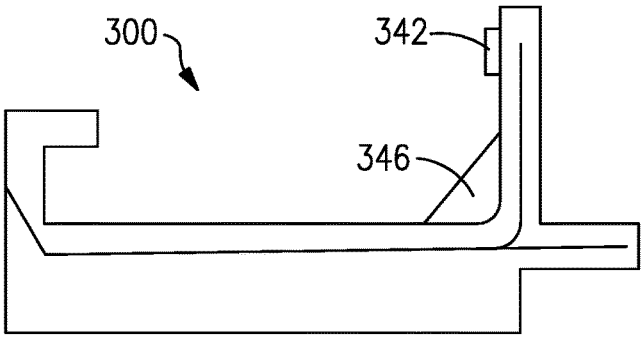
FIG. 4 schematically illustrates a cross sectional view of an alternate blade outer air seal.

The boss portions 142 minimize a gap 144 between the wall 140 and a facing surface of a static engine frame connection 200 (illustrated in FIG. 3). In the illustrated example the gap 144 is in the range of from 0.010-0.050 inches (0.254-1.27 mm). By minimizing the gap 144, the boss portion 142 and the facing surface 204 can operate in the same manner as the previous radial step and prevent axial shifting beyond the length of the minimized gap 144.

With continued reference to FIG. 2, FIG. 3 schematically illustrates a cross sectional view of the blade outer air seal 100 through one of the circumferential edges 150. Also illustrated in the cross section of FIG. 3 is the static engine frame connection 200, and an axially adjacent outer diameter flowpath component 210. In existing blade outer air seals, a radially inward protrusion 202, referred to as a support tab, is interfaced with the previously described radially extending step to prevent axial shifting. As the circumferential edge 150 is extended radially to prevent the featherseal slot from breaking through and omits the axial step, this function cannot be performed by the radial inward protrusion 202, and is replaced by the boss portion 142.

In the example of FIG. 3, the boss portion 142 extends the full radial height of the wall 140. In alternative examples, the boss portion 142 can extend a partial radially height, as long as the boss portion 142 radially overlaps the downstream end (facing surface 204) of the static engine frame 200. Further, as the boss portion 142 and the facing surface 204 act to prevent axial shifting during assembly, the support tab 202 can be reduced in some examples.

With continued reference to FIGS. 1-3, FIG. 4 schematically illustrates an alternate blade outer air seal 300 with a cross section drawn along the same position as cross section A-A of FIG. 2. In the alternate example, the boss portion 342 is discontinuous from a structural rib 346 supporting the wall portion 340. In addition, the boss portion 342 does not extend to the full radial height of the wall portion 140. Rather, the boss portion 342 extends sufficiently radially outward to interface with a corresponding facing surface of a static engine support structure (e.g. the structure 200 of FIG. 3). By reducing the size of the boss portion 342, relative to the example of FIGS. 2 and 3, the overall weight of the component can be reduced while still achieving at least some of the assembly benefits of the boss portion 342. Further, while illustrates as distinct examples, it is appreciated that aspects of the examples of FIGS. 2-4 can be interchanged, and the examples are not mutually exclusive.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gas turbine engine comprising:

a fluid flowpath connecting a multi-stage compressor section, a combustor section, and a multi-stage turbine section;

at least one stage of the multi-stage compressor section and the multi-stage turbine section comprising a ring of blade outer air seals connected to an engine case via a static support structure, wherein each blade outer air seal in the ring of blade outer air seals comprises:

a platform having a leading edge and a trailing edge;

a pair of circumferential edges connecting the leading edge and the trailing edge;

an end wall protruding radially outward from the platform at the trailing edge;

a first support rib extending axially forward from the end wall and connecting one of the circumferential edges to the end wall and structurally supporting the end wall;

a first boss portion extending axially forward from the end wall, the first boss portion being disposed radially outward of the first support rib and being tapered such that a radially outer end of the first boss portion is circumferentially thinner than a radially inner end of the first boss portion;

wherein the first boss portion is spaced apart from the static support structure such that a gap is defined between a forward facing radially aligned surface of each first boss portion and an aftward facing radially aligned surface of the static support structure.

2. The gas turbine engine of claim 1, wherein each gap has an axial length in the range of 0.010-0.050 inches (0.254-1.27 mm).

3. The gas turbine engine of claim 1, wherein each first boss portion at least partially radially overlaps the aftward facing radially aligned surface.

4. The gas turbine engine of claim 1, wherein each first boss portions extends a full radial length of the end wall.

5. The gas turbine engine of claim 1, wherein each first boss portion extends a partial radial length of the end wall.

6. The gas turbine engine of claim 1, wherein each circumferential edge in each pair of circumferential edges lacks a radial step.

7. The gas turbine engine of claim 6, wherein each circumferential edge in each pair of circumferential edges includes a circumferentially intruding feather seal slot.

* * * * *